US011282442B2

(12) United States Patent
Weng et al.

(10) Patent No.: US 11,282,442 B2
(45) Date of Patent: Mar. 22, 2022

(54) PIXEL DRIVING CIRCUIT AND DRIVING METHOD THEREOF, AND DISPLAY PANEL

(71) Applicants: FUZHOU BOE OPTOELECTRONICS TECHNOLOGY CO., LTD., Fuzhou (CN); BOE TECHNOLOGY GROUP CO., LTD., Beijing (CN)

(72) Inventors: Zuwei Weng, Beijing (CN); Yichiang Lai, Beijing (CN); Weize Xu, Beijing (CN); Bin Weng, Beijing (CN); Nani Liu, Beijing (CN); Juijian Han, Beijing (CN); Yupeng Huang, Beijing (CN); Qianglong Li, Beijing (CN)

(73) Assignees: FUZHOU BOE OPTOELECTRONICS TECHNOLOGY CO., LTD., Fujian (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/056,293

(22) PCT Filed: Mar. 12, 2020

(86) PCT No.: PCT/CN2020/079019
§ 371 (c)(1),
(2) Date: Nov. 17, 2020

(87) PCT Pub. No.: WO2020/187128
PCT Pub. Date: Sep. 24, 2020

(65) Prior Publication Data

US 2021/0210001 A1 Jul. 8, 2021

(30) Foreign Application Priority Data

Mar. 20, 2019 (CN) ..... 201910214975.7

(51) Int. Cl.
*G09G 3/32* (2016.01)
*G09G 3/20* (2006.01)

(52) U.S. Cl.
CPC ..... *G09G 3/32* (2013.01); *G09G 3/2092* (2013.01); *G09G 2300/043* (2013.01)

(58) Field of Classification Search
CPC ... G09G 3/32; G09G 3/2092; G09G 2300/043
See application file for complete search history.

(56) References Cited

U.S. PATENT DOCUMENTS 9,214,506 B2 12/2015 Xie
9,679,516 B2 6/2017 Chung et al.
(Continued)

FOREIGN PATENT DOCUMENTS

CN 101814268 A 8/2010
CN 102982767 A 3/2013
(Continued)

OTHER PUBLICATIONS

First Chinese Office Action dated Apr. 1, 2020, for corresponding Chinese Application No. 201910214975.7.
(Continued)

*Primary Examiner* — Vijay Shankar
*Assistant Examiner* — Nathaniel P Brittingham
(74) *Attorney, Agent, or Firm* — Kinney & Lange, P.A.

(57) ABSTRACT

The present disclosure provides a pixel driving circuit, a method for driving the pixel driving circuit, and a display panel. The pixel driving circuit includes: a driving circuit coupled to a first control signal terminal and a data signal terminal, and configured to generate a driving current based on a signal from the data signal terminal under control of a signal from the first control signal terminal; and a compensation circuit coupled to the first control signal terminal, a second control signal terminal, an output signal terminal,
(Continued)

and the driving circuit, and configured to perform a threshold voltage compensation on the driving circuit and provide the driving current generated by the driving circuit to the output signal terminal, under control of a signal from a first control signal terminal and a signal from the second control signal terminal.

12 Claims, 6 Drawing Sheets

(56) References Cited

U.S. PATENT DOCUMENTS

| | | | | |
|---|---|---|---|---|
| 9,734,761 | B2 | 8/2017 | Kim et al. | |
| 10,885,845 | B2 | 1/2021 | Gai et al. | |
| 2014/0159609 | A1* | 6/2014 | Xie | H01L 27/3265 315/228 |
| 2015/0084842 | A1 | 3/2015 | Kim et al. | |
| 2016/0104419 | A1 | 4/2016 | Chung et al. | |
| 2017/0018226 | A1* | 1/2017 | Yang | G09G 3/3233 |
| 2019/0180687 | A1 | 6/2019 | Gai et al. | |

FOREIGN PATENT DOCUMENTS

| | | | |
|---|---|---|---|
| CN | 103198793 | A | 7/2013 |
| CN | 103440840 | A | 12/2013 |
| CN | 105679249 | A | 6/2016 |
| CN | 106205479 | A | 12/2016 |
| CN | 108109590 | A | 6/2018 |
| CN | 109785794 | A | 5/2019 |
| EP | 1393293 | B1 | 11/2010 |
| WO | 02/082416 | A1 | 10/2002 |

OTHER PUBLICATIONS

Second Chinese Office Action dated Sep. 30, 2020, for corresponding Chinese Application No. 201910214975.7.
Third Chinese Office Action dated Feb. 1, 2021, for corresponding Chinese Application No. 201910214975.7.

* cited by examiner

PIXEL DRIVING CIRCUIT AND DRIVING METHOD THEREOF, AND DISPLAY PANEL

CROSS-REFERENCE TO RELATED APPLICATION(S)

This application is a Section 371 National Stage Application of PCT Application No. PCT/CN2020/079019, filed on Mar. 12, 2020, entitled "PIXEL DRIVING CIRCUIT AND DRIVING METHOD THEREOF, AND DISPLAY PANEL", which claims priority to Chinese Patent Application No. 201910214975.7, filed on Mar. 20, 2019, which is incorporated herein by reference in its entirety.

TECHNICAL FIELD

The present disclosure relates to a field of display technology, and in particular to a pixel driving circuit, a method for driving the pixel driving circuit, and a display panel.

BACKGROUND

In traditional display panels, such as Organic Light-Emitting Diode (OLED) display panels, uneven distribution of threshold voltages of transistors used to drive light-emitting elements in a display driving circuit on the display panel causes the threshold voltages to shift, thereby affecting the display effect.

SUMMARY

The embodiments of present disclosure provide a pixel driving circuit, a method for driving the pixel driving circuit, and a display panel.

According to an aspect of the embodiments of the present disclosure, there is provided a pixel driving circuit, comprising: a driving circuit coupled to a first control signal terminal and a data signal terminal, and configured to generate a driving current based on a signal from the data signal terminal under control of a signal from the first control signal terminal; and a compensation circuit coupled to the first control signal terminal, a second control signal terminal, an output signal terminal, and the driving circuit, and configured to perform a threshold voltage compensation on the driving circuit and provide the driving current generated by the driving circuit to the output signal terminal, under control of a signal from a first control signal terminal and a signal from the second control signal terminal.

For example, the driving circuit comprises: a driving sub-circuit having a control terminal, an input terminal, and an output terminal, and configured to generate the driving current flowing from the input terminal to the output terminal under control of a potential at the control terminal and a potential at the output terminal; and a first control sub-circuit coupled to the first control signal terminal, the data signal terminal, and the control terminal of the driving sub-circuit, and configured to input a potential at the data signal terminal to the control terminal of the driving sub-circuit under control of the signal from the first control signal terminal.

For example, the compensation circuit comprises: a compensation sub-circuit coupled to the control terminal of the driving sub-circuit, the output terminal of the driving sub-circuit, the first control signal terminal, the second control signal terminal, and a reference signal terminal, and configured to control a potential at the control terminal of the driving sub-circuit and a potential at the output terminal of the driving sub-circuit by using a potential at the reference signal terminal under control of the signal from the first control signal terminal and the signal from the second control signal terminal; and a second control sub-circuit coupled to the second control signal terminal, the output terminal of the driving sub-circuit, and the output signal terminal, and configured to couple the output terminal of the driving sub-circuit to the output signal terminal under control of the signal from the second control signal terminal.

For example, the reference signal terminal comprises a first reference signal terminal and a second reference signal terminal, and the compensation sub-circuit comprises a first transistor, a second transistor, a first capacitor, and a second capacitor, wherein a gate of the first transistor is coupled to the second control signal terminal, a first electrode of the first transistor is coupled to the first reference signal terminal, and a second electrode of the first transistor is coupled to the control terminal of the driving sub-circuit; a first terminal of the first capacitor is coupled to the control terminal of the driving sub-circuit, and a second terminal of the first capacitor is coupled to the first reference signal terminal; a first terminal of the second capacitor is coupled to the first reference signal terminal, and a second terminal of the second capacitor is coupled to the output terminal of the driving sub-circuit; and a gate of the second transistor is coupled to the first control signal terminal, a first electrode of the second transistor is coupled to the second reference signal terminal, and a second electrode of the second transistor is coupled to the output terminal of the driving sub-circuit.

For example, the second control sub-circuit comprises a third transistor, a gate of the third transistor is coupled to the second control signal terminal, and a first electrode of the third transistor is coupled to the output terminal of the driving sub-circuit, and a second electrode of the third transistor is coupled to the output signal terminal.

For example, the driving sub-circuit comprises a fourth transistor, a gate of the fourth transistor is used as the control terminal of the driving sub-circuit, and a first electrode of the fourth transistor is used as the input terminal of the driving sub-circuit to couple to a power signal terminal, and a second electrode of the fourth transistor is used as the output terminal of the driving sub-circuit.

For example, the first control sub-circuit comprises a fifth transistor, a gate of the fifth transistor is coupled to the first control signal terminal, and a first electrode of the fifth transistor is coupled to the data signal terminal, and a second electrode of the fifth transistor is coupled to the control terminal of the driving sub-circuit.

For example, the first reference signal terminal is coupled to receive a first reference voltage, the second reference signal terminal is coupled to receive a second reference voltage, and the data signal terminal is coupled to receive a data signal, wherein the first reference voltage is higher than a voltage of the data signal, and the voltage of the data signal is higher than the second reference voltage.

According to another aspect of the present disclosure, there is provided a display panel comprising the pixel driving circuit described above.

According to another aspect of the present disclosure, there is provided a method for driving the pixel driving circuit described above, comprising that: a first control signal is applied to the first control signal terminal, a data signal is applied to the data signal terminal, and a second control signal is applied to the second control signal terminal; and the driving circuit generates a driving current based on the data signal under control of the first control signal, and the compensation circuit performs a threshold voltage compensation on the driving sub-circuit and provides the driving current generated by the driving sub-circuit to the output signal terminal, under control of the first control signal and the second control signal.

For example, the method further comprising: applying a reference voltage to the compensation circuit, wherein the compensation circuit performs the threshold voltage compensation on the driving sub-circuit by using the reference voltage under control of the first control signal and the second control signal.

For example, the reference voltage comprises a first reference voltage and a second reference voltage, the driving circuit comprises a driving sub-circuit and a first control sub-circuit, and the compensation circuit comprises a compensation sub-circuit and a second control sub-circuit, wherein in a first period, the first control signal being at a first level is applied to the first control signal terminal, the first control sub-circuit inputs a potential at the data signal terminal to a control terminal of the driving sub-circuit, and the compensation sub-circuit inputs the second reference voltage to an output terminal of the driving sub-circuit; in a second period, the first control signal is changed from the first level to a second level, and the compensation sub-circuit stores a compensation voltage related to a threshold voltage of the driving sub-circuit at the output terminal of the driving sub-circuit; and in a third period, the second control signal being at the first level is applied to the second control signal terminal, and the compensation sub-circuit adjusts a potential at the control terminal of the driving sub-circuit and a potential at the output terminal of the driving sub-circuit by using the first reference voltage, so that the driving current generated by the driving sub-circuit is independent of the threshold voltage, and the second control sub-circuit couples the output terminal of the driving sub-circuit to the output signal terminal to output the generated driving current.

For example, the first reference voltage is higher than a voltage of the data signal and the voltage of the data signal is higher than the second reference voltage.

DETAILED DESCRIPTION OF EMBODIMENTS

Figure 1:
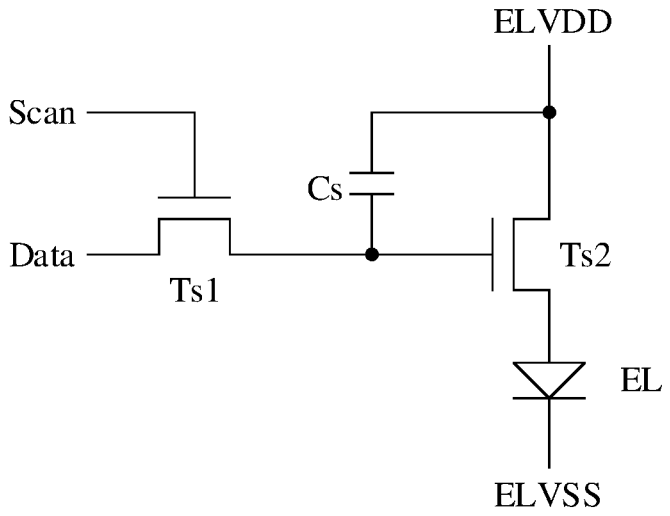
FIG. 1 shows a circuit diagram of a pixel driving circuit.

In order to make the objectives, technical solutions, and advantages of the embodiments of the present disclosure clearer, the technical solutions in the embodiments of the present disclosure will be described clearly and completely in conjunction with the accompanying drawings in the embodiments of the present disclosure. Obviously, the described embodiments are part of the embodiments of the present disclosure, but not all of them. Based on the described embodiments of the present disclosure, all other embodiments obtained by those of ordinary skill in the art without creative labor are within the protection scope of the present disclosure. It should be noted that throughout the drawings, the same elements are indicated by the same or similar reference signs. In the following description, some specific embodiments are only used for descriptive purposes, and should not be construed as limiting the present disclosure, but are merely examples of the embodiments of the present disclosure. When it may cause confusion in the understanding of the present disclosure, conventional structures or configurations will be omitted. It should be noted that the shape and size of each component in the figure do not reflect the actual size and ratio, but merely illustrate the content of the embodiment of the present disclosure.

Unless otherwise defined, the technical or scientific terms used in the embodiments of the present disclosure should have the usual meanings understood by those skilled in the art. The "first", "second" and similar words used in the embodiments of the present disclosure do not indicate any order, quantity, or importance, but are only used to distinguish different components.

In addition, in the description of the embodiments of the present disclosure, the term "connected" or "connected to" may mean that two components are directly connected, or that two components are connected via one or more other components. In addition, these two components can be connected or coupled by wired or wireless means.

In addition, in the description of the embodiments of the present disclosure, the terms "first level" and "second level" are only used to distinguish the two levels from being different in amplitude. For example, in the following description, the "first level" is a high level and the "second level" is a low level as an example. Those skilled in the art can understand that the present disclosure is not limited thereto.

The transistors used in the embodiments of the present disclosure may all be thin film transistors or field effect transistors or other devices with the same characteristics. For example, the thin film transistor used in the embodiments of the present disclosure may be an oxide semiconductor transistor. Since the source and drain of the switching thin film transistor used here are symmetrical, the source and drain may be interchanged. In the embodiments of the present disclosure, one of the source and the drain is called a first electrode, and the other of the source and the drain is called a second electrode. In the following examples, an N-type thin film transistor is taken as an example for description.

FIG. 1 shows a circuit diagram of a pixel driving circuit. The pixel driving circuit in FIG. 1 adopts a 2T1C structure, that is, the pixel driving circuit includes two transistors (transistors Ts1 and Ts2 in FIG. 1) and one capacitor (capacitor Cs in FIG. 1). A gate of the transistor Ts1 is coupled to a scan signal terminal Scan, a first electrode of the transistor Ts1 is coupled to a data signal terminal Data, and a second electrode of the transistor Ts1 is coupled to a gate of the transistor Ts2. A first electrode of the transistor Ts2 is coupled to a power signal terminal ELVDD, and a second electrode of the transistor Ts2 is coupled to an input terminal of a light-emitting element EL. An output terminal of the light-emitting element EL is coupled to a reference signal terminal ELVSS. A first terminal of the capacitor Cs is coupled to the gate of the transistor Ts2, and a second terminal of the capacitor Cs is coupled to the first electrode of the transistor Ts2. When the scan signal terminal Scan is at a high level, the transistor Ts1 is turned on, and a potential at the data signal terminal Data is input to the gate of the transistor Ts2 to turn on the transistor Ts2. When the scan signal terminal Scan is at a low level, the transistor Ts1 is turned off. Due to an existence of the capacitor Cs, the potential at the data signal terminal Data may be stored at the gate of the transistor Ts2, so that the transistor Ts2 is continuously turned on and a current flowing through the transistor Ts2 drives the light-emitting element EL to emit light. In this way, the pixel driving circuit converts a voltage signal from the data signal terminal into a driving current required to drive the light-emitting element EL to emit light, so as to drive the light-emitting element EL to display in different gray levels.

Due to factors such as a manufacturing process, a threshold voltage of the transistors Ts2 used to generate the driving current in each pixel driving circuit on the display panel is different. Since the current flowing through the light-emitting element EL is related to the threshold voltage of the transistor Ts2, a difference in the threshold voltage may affect the display of the light-emitting element EL. In addition, since the current flowing through the light-emitting element EL is also related to a potential at the reference signal terminal ELVSS, an unstable potential (for example, IR drop) at the reference signal terminal ELVSS may also affect the display of the light-emitting element EL.

The embodiments of the present disclosure provide a pixel driving circuit, a method for driving the pixel driving circuit, and a display panel. A compensation circuit performs threshold voltage compensation on a driving sub-circuit under control of a signal from a first control signal terminal and a signal from a second control signal terminal, and provides the driving current generated by the driving sub-circuit to the output signal terminal, so that the current flowing through the light-emitting element is not affected by the threshold voltage, thereby improving the display effect.

Figure 2:
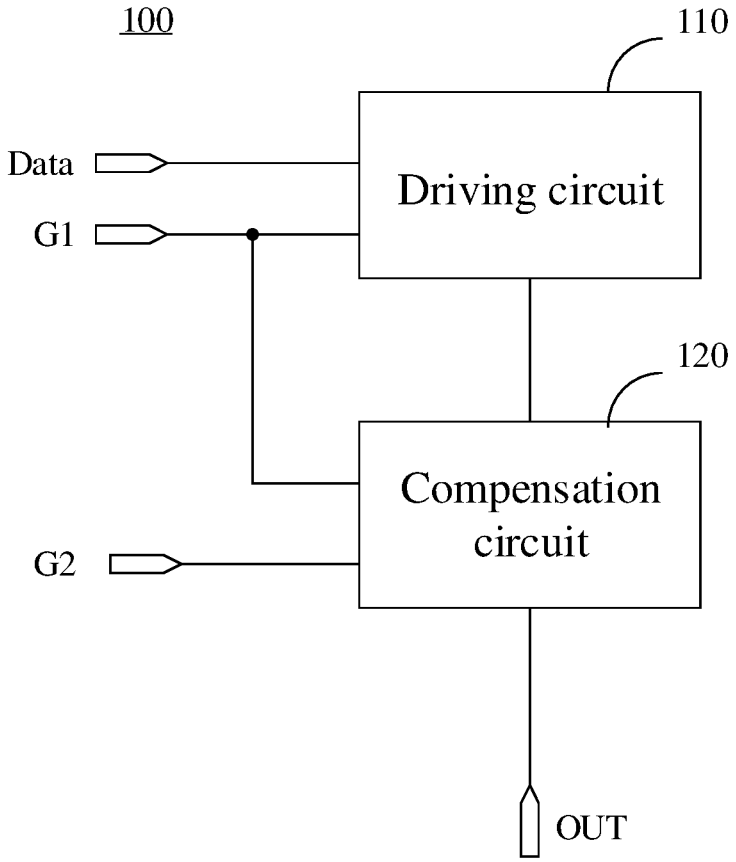
FIG. 2 shows a schematic block diagram of a pixel driving circuit according to an embodiment of the present disclosure.

FIG. 2 shows a schematic block diagram of a pixel driving circuit according to an embodiment of the present disclosure.

As shown in FIG. 2, the pixel driving circuit 100 includes a driving circuit 110 and a compensation circuit 120. The driving circuit 110 is coupled to a first control signal terminal G1 and a data signal terminal Data. The driving circuit 110 may generate a driving current based on a signal from the data signal terminal Data under control of a signal from the first control signal terminal G1. The compensation circuit 120 is coupled to the first control signal terminal G1, a second control signal terminal G2, an output signal terminal OUT, and the driving circuit 110. The compensation circuit 120 may perform threshold voltage compensation on the driving circuit 110 under control of a signal from the first control signal terminal G1 and a signal from the second control signal terminal G2 and provide a driving current generated by the driving circuit 110 to the output signal terminal OUT.

Figure 3:
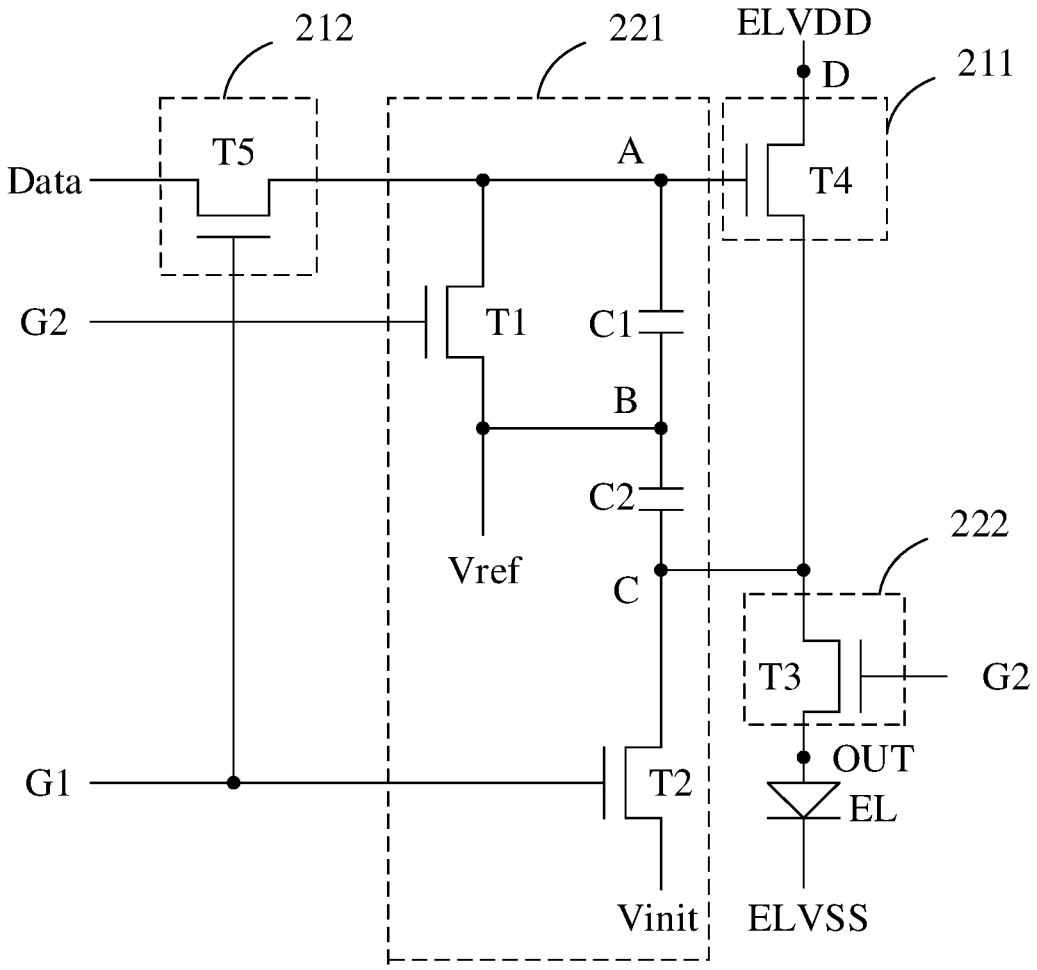
FIG. 3 shows an example circuit diagram of a pixel driving circuit according to an embodiment of the present disclosure.

FIG. 3 shows an example circuit diagram of a pixel driving circuit according to an embodiment of the present disclosure. As shown in FIG. 3, the pixel driving circuit 200 includes a driving circuit and a compensation circuit.

The driving circuit may include a driving sub-circuit 211 and a first control sub-circuit 212.

The driving sub-circuit 211 has a control terminal A, an input terminal D, and an output terminal C. The driving sub-circuit 211 may generate a driving current flowing from the input terminal D to the output terminal C under control of a potential at the control terminal A and a potential at the output terminal C, and the driving current is used to drive the light-emitting element EL to emit light. The light-emitting element EL may be an electroluminescent element, such as but not limited to OLED. For example, as shown in FIG. 3, the driving sub-circuit 211 may include a transistor T4. A gate of the transistor T4 is used as the control terminal A of the driving sub-circuit 211; a first electrode of the transistor T4 is used as the input terminal D of the driving sub-circuit 211 to couple to a power signal terminal (a system power signal terminal ELVDD in FIG. 3); and a second electrode of the transistor T4 is used as the output terminal C of the driving sub-circuit 211.

The first control sub-circuit 212 is coupled to the first control signal terminal G1, the data signal terminal Data, and the control terminal A of the driving sub-circuit 211. The first control sub-circuit 212 may input a potential at the data signal terminal Data to the control terminal A of the driving sub-circuit 211 under control of the signal from the first control signal terminal G1. For example, as shown in FIG. 3, the first control sub-circuit 212 may include a transistor T5. A gate of the transistor T5 is coupled to the first control signal terminal G1, a first electrode of the transistor T5 is coupled to the data signal terminal Data, and a second electrode of the transistor T5 is coupled to the control terminal A of the driving sub-circuit 211.

The compensation circuit may include a compensation sub-circuit 221 and a second control sub-circuit 222.

The compensation sub-circuit 221 is coupled to the control terminal A and the output terminal C of the driving sub-circuit 211, the first control signal terminal G1, the second control signal terminal G2, and a reference signal terminal. For example, in FIG. 3, the reference signal terminal may include a first reference signal terminal Vref and a second reference signal terminal Vinit. The compensation sub-circuit 221 may use a potential at the reference signal terminal to control a potential at the control terminal A and a potential at the output terminal C of the driving sub-circuit 211 under control of the signal from the first control signal terminal G1 and the signal from the second control signal terminal G2. For example, in FIG. 3, the compensation sub-circuit 221 may include a transistor T1, a transistor T2, a capacitor C1, and a capacitor C2. A gate of the transistor T1 is coupled to the second control signal terminal G2, a first electrode of the transistor T1 is coupled to the first reference signal terminal Vref, and a second electrode of the transistor T1 is coupled to the control terminal A of the driving sub-circuit 211. A first terminal of the capacitor C1 is coupled to the control terminal A of the driving sub-circuit 211, and a second terminal of the capacitor C1 is coupled to the first reference signal terminal Vref. A first terminal of the capacitor C2 is coupled to the first reference signal terminal Vref, and a second terminal of the capacitor C2 is coupled to the output terminal C of the driving sub-circuit 211. A node between the capacitor C1 and the capacitor C2 is denoted by B. A gate of the transistor T2 is coupled to the first control signal terminal G1, a first electrode of the transistor T2 is coupled to the second reference signal terminal Vinit, and a second electrode of the transistor T2 is coupled to the output terminal C of the driving sub-circuit 211. The first reference signal terminal Vref may be coupled to receive a first reference voltage V1, the second reference signal terminal Vinit may be coupled to receive a second reference voltage V2, and the data signal terminal Data may be coupled to receive a data signal. A voltage of the data signal is indicated by Vdata. In some embodiments, the first reference voltage V1, the second reference voltage V2, and the voltage of the data signal Vdata may be set to satisfy V1>Vdata>V2, for example, the first reference voltage V1 and the voltage of the data signal Vdata are positive voltages, the second reference voltage V2 is a negative voltage.

The second control sub-circuit 222 is coupled to the second control signal terminal G2, the output terminal C of the driving sub-circuit 211, and the output signal terminal OUT. The signal output terminal OUT of the pixel driving circuit 200 may be coupled to the input terminal of the light-emitting element EL, so that the driving current generated by the pixel driving circuit 200 flows through the light-emitting element EL to drive the light-emitting element EL to emit light. The output terminal of the light-emitting element EL is coupled to the third reference signal terminal (the system reference signal terminal ELVSS in FIG. 3). The second control sub-circuit 222 may couple the output terminal C of the driving sub-circuit 211 to the output signal terminal OUT under control of the signal from the second control signal terminal G2 to provide the driving current generated by the driving sub-circuit 211 to the light-emitting element EL, and thus driving the light-emitting element EL to emit light. For example, in FIG. 3, the second control sub-circuit 222 may include a transistor T3, a gate of the transistor T3 is coupled to the second control signal terminal G2, a first electrode of the transistor T3 is coupled to the output terminal C of the driving sub-circuit 211, and a second electrode of transistor T3 is coupled to the output signal terminal OUT.

An embodiment of the present disclosure also provides a method for driving the above-mentioned pixel driving circuit, which will be described in detail below with reference to FIGS. 4 and 5.

Figure 4:
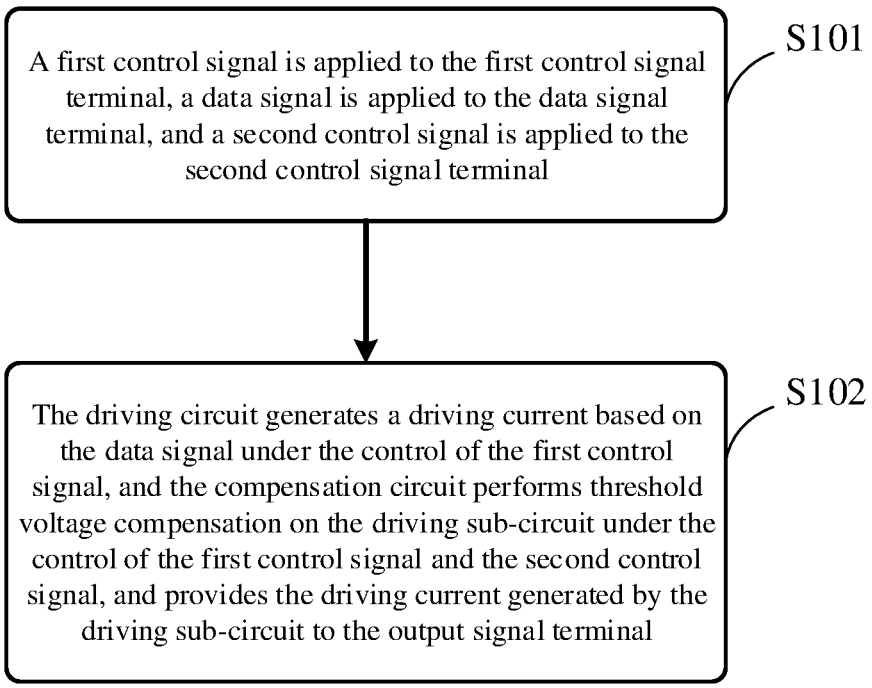
FIG. 4 shows a flowchart of a method for driving a pixel driving circuit according to an embodiment of the present disclosure.

FIG. 4 shows a flowchart of a method for driving the pixel driving circuit according to an embodiment of the present disclosure. The method may be applied to the aforementioned pixel driving circuits, such as the pixel driving circuits 100 and 200.

In step S101, a first control signal is applied to the first control signal terminal, a data signal is applied to the data signal terminal, and a second control signal is applied to the second control signal terminal.

In step S102, the driving circuit generates a driving current based on the data signal under the control of the first control signal, and the compensation circuit performs threshold voltage compensation on the driving sub-circuit under the control of the first control signal and the second control signal, and provides the driving current generated by the driving sub-circuit to the output signal terminal.

In some embodiments, a reference voltage may also be applied to the compensation circuit, and the compensation circuit may perform threshold voltage compensation on the driving sub-circuit based on the reference voltage under the control of the first control signal and the second control signal.

Although steps of the method are described in a specific order above, it should be clear to those skilled in the art that the operation order of the method of the embodiment of the present disclosure is not limited to this, and steps S101 and S102 may be performed in other orders.

Figure 5:
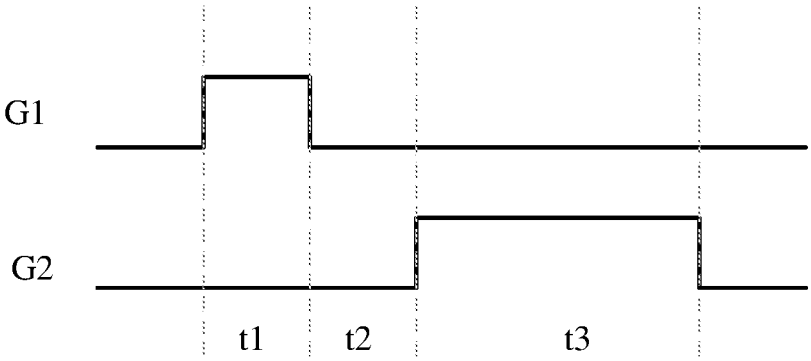
FIG. 5 shows a signal timing diagram of a pixel driving circuit according to an embodiment of the present disclosure.

FIG. 5 shows a signal timing diagram of a pixel driving circuit according to an embodiment of the present disclosure. This signal timing may be applied to the aforementioned pixel driving circuits, such as the pixel driving circuits 100 and 200.

Hereinafter, referring to FIG. 5, the pixel driving circuit 200 is taken as an example to describe the signal timing of the pixel driving circuit of the embodiment of the present disclosure. For example, the first control signal may be applied to the first control signal terminal G1 of the pixel driving circuit 200, the second control signal may be applied to the second control signal terminal G2, the first reference voltage V1 may be applied to the first reference signal terminal Vref, the second reference voltage V2 may be applied to the second reference signal terminal Vinit, and the data signal may be applied to the data signal terminal Data, the voltage of the data signal is indicated by Vdata. The first reference voltage V1, the second reference voltage V2, and the voltage of the data signal Vdata may be set to satisfy V1>Vdata>V2, for example, the first reference voltage V1 and the voltage of the data signal Vdata are positive voltages, and the second reference voltage V2 is a negative voltage.

In a first period t1, the first control signal being at a high level is applied to the first control signal terminal G1, and the first control sub-circuit 212 inputs the potential at the data signal terminal Data (i.e., the voltage of the data signal Vdata) to the control terminal A of the driving sub-circuit 211. The compensation sub-circuit 221 inputs the second reference voltage V2 at the second reference signal terminal Vinit to the output terminal C of the driving sub-circuit 211. For example, in this period, since the first control signal terminal G1 is at a high level and the second control signal terminal G2 is at a low level, the transistors T5 and T2 are turned on, and the transistors T1 and T3 are turned off, so that the voltage of the data signal Vdata at the data signal terminal Data is input to the control terminal A of the driving sub-circuit 211, and the second reference voltage V2 at the second reference signal terminal Vinit is input to the output terminal C of the driving sub-circuit 211. At this time, since the node B is coupled to the first reference signal terminal Vref, the first reference voltage V1 at the first reference signal terminal Vref is input to the node B. This period is also called a data input phase.

In a second period t2, the first control signal from the first control signal terminal G1 changes from being at a high level to be at a low level, and the compensation sub-circuit 221 stores a compensation voltage related to the threshold voltage Vth of the driving sub-circuit 211 (for example, the transistor T4) at the output terminal C of the driving sub-circuit 211. For example, during this period, since the first control signal terminal G1 changes to be at a low level, the transistors T2 and T5 are turned off; since the second control signal terminal G2 is still at a low level, the transistors T1 and T3 remain in an off state. The existence of the capacitors C1 and C2 causes the potential at the control terminal A of the driving sub-circuit 211 maintained at Vdata, and the potential at the output terminal C of the driving sub-circuit 211 maintained at V2. Since Vdata is greater than V2, for example, it may be set as Vdata−V2>Vth, which causes the gate and source voltage of the transistor T4 Vgs=Vdata−V2>Vth, so that the transistor T4 is turned on and charges the output terminal C of the driving sub-circuit 211 until the potential at the output terminal C of the driving sub-circuit 211 reaches Vdata-Vth, the transistor T4 is turned off, and the potential at the output terminal C of the driving sub-circuit 211 is maintained at Vdata-Vth. In other words, Vdata-Vth is stored as a compensation voltage at the output terminal C of the driving sub-circuit 211. This period is also called a compensation phase.

In a third period t3, the second control signal being at a high level is applied to the second control signal terminal G2, and the compensation sub-circuit 221 uses the second reference voltage V2 to adjust the potential at the control terminal A of the driving sub-circuit 211 and the potential at the output terminal C of the driving sub-circuit 211, so that the driving current generated by the driving sub-circuit 211 is independent of the threshold voltage Vth, and the second control sub-circuit 222 couples the output terminal C of the driving sub-circuit 211 to the output signal terminal OUT to output the generated driving current. For example, in this period, since the first control signal terminal G1 is at a low level and the second control signal terminal G2 is at a high level, the transistors T2 and T5 are turned off, and the transistors T1 and T3 are turned on. The transistor T1 is turned on so that the first reference voltage V1 at the first reference signal terminal Vref is input to the control terminal A of the driving sub-circuit 211. Due to the existence of the capacitors C1 and C2, the potential at the control terminal A of the driving sub-circuit 211 is maintained at V1, the potential at the output terminal C of the driving sub-circuit 211 is maintained at Vdata-Vth. At this time, the gate and source voltage of the transistor T4 is Vgs=V1−(Vdata−Vth). Since V1>Vdata, Vgs−Vth>0, so that the transistor T4 is turned on and a driving current flowing from the input terminal D to the output terminal C is generated. At this time, since the transistor T3 is turned on, the output terminal C of the driving sub-circuit 211 is coupled to the output signal terminal OUT of the pixel driving circuit 200, so that the driving current is provided to the input terminal of the light-emitting element EL to drive the light-emitting element EL to emit light. This phase is also called a display phase. In the display phase, the current flowing through the transistor T4 satisfies a following equation (1):

$$I = \frac{1}{2}Cox\frac{uW}{L}(Vgs - Vth)^2 \tag{1}$$

where I indicates a current flowing through the transistor T4, Cox indicates a channel capacitance per unit area of the transistor T4, u indicates a channel mobility of the transistor T4, W indicates a channel width of the transistor T4, and L indicates a channel length of the transistor T4.

From this, a following equation (2) may be inferred:

$$\text{Ioled} = \frac{1}{2}Cox\frac{uW}{L}[(V1 - Vdata + Vth) - Vth)]^2 = \frac{1}{2}Cox\frac{uW}{L}(V1 - Vdata)^2 \tag{2}$$

where Ioled indicates a current flowing through the light-emitting element EL, V1 indicates a first reference voltage applied to the first reference signal terminal Vref, and Vdata indicates a voltage of the data signal.

It may be seen from the above equation (2) that the current Ioled flowing through the light-emitting element EL has nothing to do with the threshold voltage Vth of the transistor T4, so the light emission of the light-emitting element EL is not affected by the shift of the threshold voltage Vth, thereby realizing threshold voltage compensation. In addition, it may be seen from equation (2) that the current Ioled flowing through the light-emitting element EL is related to the potential at the first reference signal terminal Vref, but has nothing to do with the potential at the system reference signal terminal ELVSS, so the light emission of the light-emitting element EL is not affected by voltage fluctuations (such as IR voltage drop) at the system reference signal terminal ELVSS. Moreover, since the first reference signal terminal Vref of the embodiment of the present disclosure is a reference signal terminal separately provided for threshold voltage compensation, a current passing through the first reference signal terminal Vref is substantially zero, so that voltage fluctuations of the first reference signal terminal Vref are much smaller than that of the system reference signal terminal ELVSS supplying power to various components in the display panel, therefore having basically no effect on the display. Compared with the conventional technology, the embodiments of the present disclosure may improve the display effect.

In FIG. 5, the third period t3 may be set to be longer than the duration of the first period t1, thereby ensuring that the light-emitting element EL is driven to emit light for a sufficiently long time during the display phase. However, it should be clear to those skilled in the art that the embodiments of the present disclosure are not limited to this, and the duration of the first period t1, the second period t2, and the third period t3 may be set according to needs, and will not be repeated here.

An embodiment of the present disclosure also provides a display panel including the above-mentioned pixel driving circuit. This will be described in detail below with reference to FIG. 6.

Figure 6:
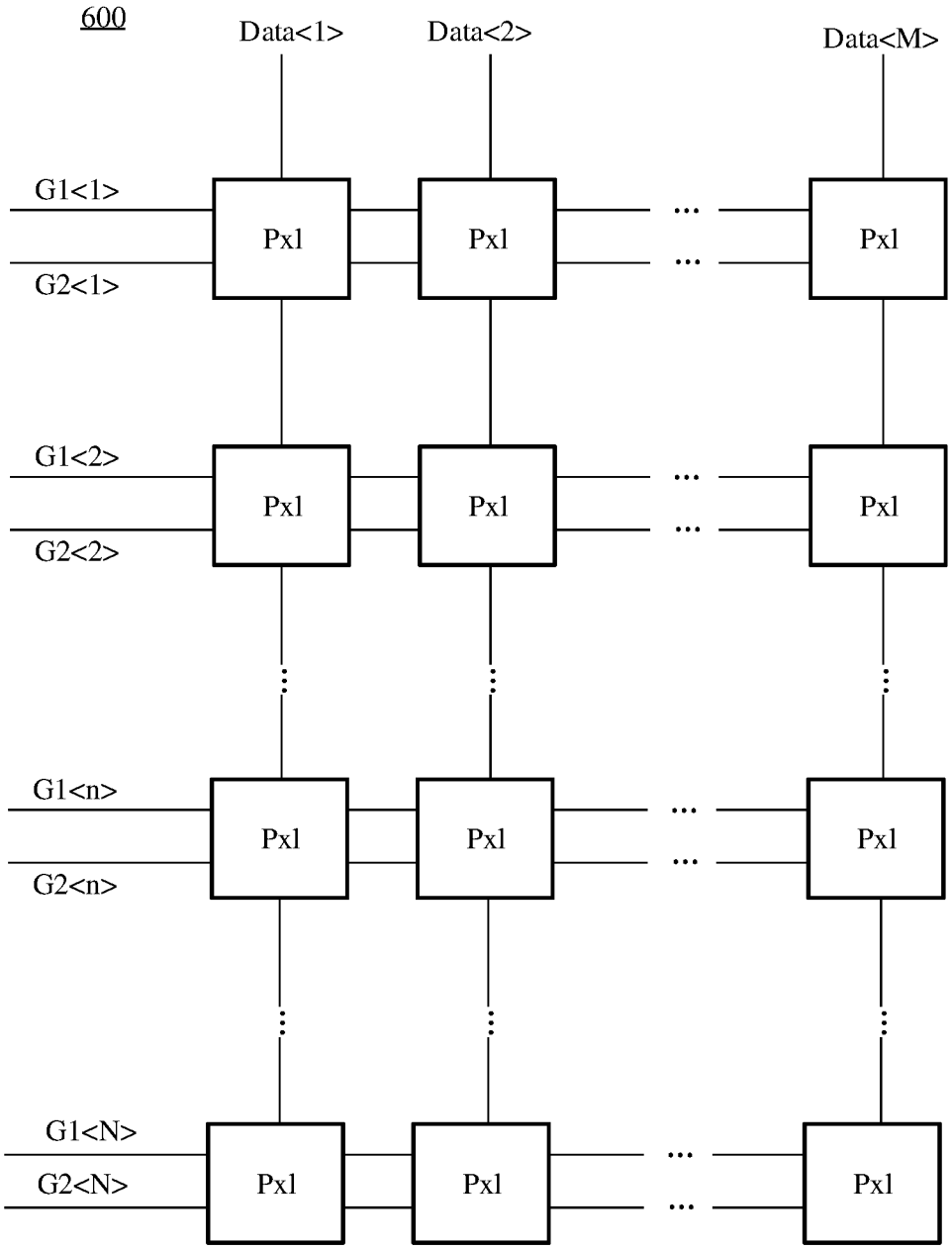
FIG. 6 shows a schematic diagram of a display panel according to an embodiment of the present disclosure.

FIG. 6 shows a schematic diagram of a display panel according to an embodiment of the present disclosure. As shown in FIG. 6, the display panel 600 includes a pixel unit Px1, and the pixel unit Px1 may include the above-described pixel driving circuit, such as the pixel driving circuit 100 or 200. The pixel unit Px1 may further include a light-emitting unit coupled to the pixel driving circuit, and the driving current generated by the pixel driving circuit drives the light-emitting unit to emit light. For example, in FIG. 6, the display panel 600 includes a plurality of pixel units Px1 arranged in an N×M array, where N and M are integers greater than 1. The first control signal terminals of each row of pixel driving units are coupled together to receive the first control signal for this row of pixel units, and the second control signal terminals are coupled together to receive the second control signal for this row of pixel units. The data signal terminals of each column of pixel units are coupled together to receive the data signal for this column of pixel units. For example, as shown in FIG. 6, the first control signal terminals of the $n^{th}$ row of the pixel units receives a first control signal G1<n> for the $n^{th}$ row of the pixel units, and the second control signal terminal receives the second control signal G2<n> for the $n^{th}$ row of the pixel units, where n is an integer, and 1≤n≤N. Similarly, the data signal terminals of the $m^{th}$ column of the pixel units receives a first control signal Data<m> for the $m^{th}$ column of pixel units, where m is an integer and 1≤m≤M, which will not be repeated here. The display panel 600 according to an embodiment of the present disclosure may be an OLED display panel, such as an Active-Matrix Organic Light-Emitting Diode (AMOLED) display panel. However, it should be clear to those skilled in the art that the above are only examples, and the type, structure, and layout of the display panel in the embodiments of the present disclosure are not limited thereto.

An embodiment of the present disclosure also provides a display device, which includes the above-mentioned display panel. This will be described in detail below with reference to FIG. 7.

Figure 7:
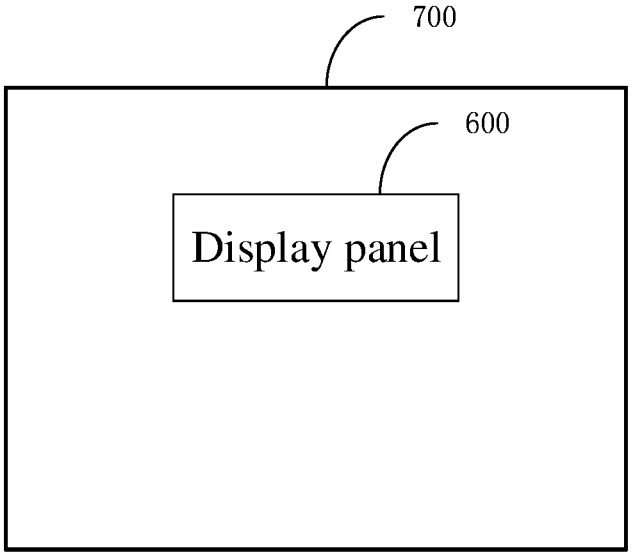
FIG. 7 shows a schematic diagram of a display device according to an embodiment of the present disclosure.

FIG. 7 shows a schematic diagram of a display device according to an embodiment of the present disclosure. As shown in FIG. 7, the display device 700 includes the above-mentioned display panel 600. For example, the display device 700 may further include a display driving circuit for driving the display panel 600 to display, such as a gate driving circuit, a source driving circuit, a timing controller, etc., which will not be repeated here. The display device 700 according to the embodiment of the present disclosure may be any product or component with a display function such as electronic paper, a mobile phone, a tablet computer, a television, a display, a notebook computer, a digital photo frame, a navigator, etc.

Those skilled in the art may understand that the embodiments described above are all exemplary, and those skilled in the art may improve them, and the structures described in the various embodiments may be freely combined without conflicts in structure or principle.

After describing the preferred embodiments of the present disclosure in detail, those skilled in the art may clearly understand that various changes and modifications may be made without departing from the scope and spirit of the appended claims, and the present disclosure is not limited to the implementations of the exemplary embodiments cited in the specification.

What is claimed is:

1. A pixel driving circuit, comprising:

a driving circuit coupled to a first control signal terminal and a data signal terminal, and configured to generate a driving current based on a signal from the data signal terminal under control of a signal from the first control signal terminal; and a compensation circuit coupled to the first control signal terminal, a second control signal terminal, an output signal terminal, and the driving circuit, and configured to perform a threshold voltage compensation on the driving circuit and provide the driving current generated by the driving circuit to the output signal terminal, under control of the signal from the first control signal terminal and a signal from the second control signal terminal, wherein the driving circuit comprises:

a driving sub-circuit having a control terminal, an input terminal, and an output terminal, and configured to generate the driving current flowing from the input terminal to the output terminal under control of a potential at the control terminal and a potential at the output terminal; and a first control sub-circuit coupled to the first control signal terminal, the data signal terminal, and the control terminal of the driving sub-circuit, and configured to input a potential at the data signal terminal to the control terminal of the driving sub-circuit under control of the signal from the first control signal terminal, wherein the compensation circuit comprises:

a compensation sub-circuit coupled to the control terminal of the driving sub-circuit, the output terminal of the driving sub-circuit, the first control signal terminal, the second control signal terminal, and a reference signal terminal, and configured to control a potential at the control terminal of the driving sub-circuit and a potential at the output terminal of the driving sub-circuit by using a potential at the reference signal terminal under control of the signal from the first control signal terminal and the signal from the second control signal terminal; and a second control sub-circuit coupled to the second control signal terminal, the output terminal of the driving sub-circuit, and the output signal terminal, and configured to couple the output terminal of the driving sub-circuit to the output signal terminal under control of the signal from the second control signal terminal, wherein the reference signal terminal comprises a first reference signal terminal and a second reference signal terminal, and the compensation sub-circuit comprises a first transistor, a second transistor, a first capacitor, and a second capacitor, wherein:

a gate of the first transistor is coupled to the second control signal terminal, a first electrode of the first transistor is coupled to the first reference signal terminal, and a second electrode of the first transistor is coupled to the control terminal of the driving sub-circuit;

a first terminal of the first capacitor is coupled to the control terminal of the driving sub-circuit, and a second terminal of the first capacitor is coupled to the first reference signal terminal;

a first terminal of the second capacitor is coupled to the first reference signal terminal, and a second terminal of the second capacitor is coupled to the output terminal of the driving sub-circuit; and a gate of the second transistor is coupled to the first control signal terminal, a first electrode of the second transistor is coupled to the second reference signal terminal, and a second electrode of the second transistor is coupled to the output terminal of the driving sub-circuit, and wherein the second control sub-circuit comprises a third transistor, a gate of the third transistor is coupled to the second control signal terminal, a first electrode of the third transistor is coupled to the output terminal of the driving sub-circuit, and a second electrode of the third transistor is coupled to the output signal terminal.

2. The pixel driving circuit according to claim 1, wherein:

the driving sub-circuit comprises a fourth transistor, a gate of the fourth transistor is used as the control terminal of the driving sub-circuit, a first electrode of the fourth transistor is used as the input terminal of the driving sub-circuit to couple to a power signal terminal, and a second electrode of the fourth transistor is used as the output terminal of the driving sub-circuit.

3. The pixel driving circuit according to claim 1, wherein the first control sub-circuit comprises a fifth transistor, a gate of the fifth transistor is coupled to the first control signal terminal, a first electrode of the fifth transistor is coupled to the data signal terminal, and a second electrode of the fifth transistor is coupled to the control terminal of the driving sub-circuit.

4. The pixel driving circuit according to claim 1, wherein the first reference signal terminal is coupled to receive a first reference voltage, the second reference signal terminal is coupled to receive a second reference voltage, and the data signal terminal is coupled to receive a data signal, wherein the first reference voltage is higher than a voltage of the data signal, and the voltage of the data signal is higher than the second reference voltage.

5. A display panel comprising the pixel driving circuit according to claim 2.

6. A display panel comprising the pixel driving circuit according to claim 3.

7. A display panel comprising the pixel driving circuit according to claim 4.

8. A display panel comprising the pixel driving circuit according to claim 1.

9. A method for driving the pixel driving circuit according to claim 1, comprising that:

a first control signal is applied to the first control signal terminal, a data signal is applied to the data signal terminal, and a second control signal is applied to the second control signal terminal; and the driving circuit generates a driving current based on the data signal under control of the first control signal, and the compensation circuit performs the threshold voltage compensation on the driving sub-circuit and provides the driving current generated by the driving sub-circuit to the output signal terminal, under control of the first control signal and the second control signal.

10. The method according to claim 9, further comprising: applying a reference voltage to the compensation circuit, wherein the compensation circuit performs the threshold voltage compensation on the driving sub-circuit by using the reference voltage under control of the first control signal and the second control signal.

11. The method according to claim 10, wherein the reference voltage comprises a first reference voltage and a second reference voltage, the driving circuit comprises a driving sub-circuit and a first control sub-circuit, and the compensation circuit comprises a compensation sub-circuit and a second control sub-circuit, wherein in a first period, the first control signal being at a first level is applied to the first control signal terminal, the first control sub-circuit inputs a potential at the data signal terminal to a control terminal of the driving sub-circuit, and the compensation sub-circuit inputs the second reference voltage to an output terminal of the driving sub-circuit;

in a second period, the first control signal is changed from the first level to a second level, and the compensation sub-circuit stores a compensation voltage related to a threshold voltage of the driving sub-circuit at the output terminal of the driving sub-circuit; and in a third period, the second control signal being at the first level is applied to the second control signal terminal, and the compensation sub-circuit adjusts a potential at the control terminal of the driving sub-circuit and a potential at the output terminal of the driving sub-circuit by using the first reference voltage, so that the driving current generated by the driving sub-circuit is independent of the threshold voltage, and the second control sub-circuit couples the output terminal of the driving sub-circuit to the output signal terminal to output the generated driving current.

12. The method according to claim 10, wherein the first reference voltage is higher than a voltage of the data signal and the voltage of the data signal is higher than the second reference voltage.

* * * * *